United States Patent [19]

Cairns et al.

[11] Patent Number: 4,531,808

[45] Date of Patent: Jul. 30, 1985

[54] BLADE COUPLING TERMINAL

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 495,233

[22] Filed: May 16, 1983

[51] Int. Cl.[3] ..... H01R 11/22

[52] U.S. Cl. ..... 339/258 S

[58] Field of Search ..... 339/59 M, 176 M, 258 R, 339/258 P, 258 F, 256 SP, 258 S

[56] References Cited

U.S. PATENT DOCUMENTS

| | | | |
|---|---|---|---|
| 1,841,736 | 1/1932 | Jones | 339/258 P |
| 3,112,145 | 11/1963 | Swengel | 339/17 |
| 3,430,185 | 2/1969 | Sitzler et al. | 339/59 M |
| 3,609,640 | 9/1971 | Longenecker et al. | 339/258 P |
| 3,718,895 | 2/1973 | Reynolds et al. | 339/258 R |
| 3,836,947 | 9/1974 | Yeager | 339/259 R |
| 4,221,456 | 9/1980 | Cairns et al. | 339/258 F |
| 4,269,468 | 5/1981 | Ammon et al. | 339/221 M |
| 4,368,939 | 1/1983 | Foederer | 339/59 M |

FOREIGN PATENT DOCUMENTS

| | | | |
|---|---|---|---|
| 1615629 | 9/1972 | Fed. Rep. of Germany . | |
| 3014614 | 11/1981 | Fed. Rep. of Germany . | |
| 1413430 | 4/1965 | France | 339/258 P |
| 457273 | 10/1965 | Japan | 339/258 R |
| 402992 | 6/1966 | Switzerland | 339/258 P |
| 2019670 | 10/1979 | United Kingdom . | |

*Primary Examiner*—Gil Weidenfeld
*Assistant Examiner*—Gary F. Paumen
*Attorney, Agent, or Firm*—Peter Abolins; Robert D. Sanborn

[57] ABSTRACT

A contact blade coupling has a pair of outside members, each member having an integral associated inside member bent along a common edge. The bending of an inside member toward an associated outside member is limited by a spacing protrusion so that inside and outside members are parallel to each other. The inside members are spring contacts and are positioned so as to be prestressed along a line of contact to provide a contact force for holding an intermediate electrical blade connector.

1 Claim, 16 Drawing Figures

BLADE COUPLING TERMINAL

BACKGROUND OF THE INVENTION

1. Field of the Invention

This invention relates to a contact structure for connecting to a blade connector.

2. Background of the Prior Art

There are known various contact structures which use a pair of generally opposed members to contact an intermediate member. For example, a terminal for receiving a bulb has an opposing pair of spaced contact springs. The bulb contacts are placed between the contact springs so they are deflected and hold the bulb in place. As another example, terminals for attaching to blade connectors are also known. It is known to have parallel opposing walls which at their leading edge are coupled to inner spring members which are bent inside toward each other. The inner spring is spaced from the outer walls and foreign material can enter in the intermediate space. Also, the construction requires a relatively large terminal to accommodate the bend toward the inner spring member.

It would be desirable to have smaller terminals which are rigidly reinforced. Reinforcing is desirable to make the terminal more resistant to accidental abuse during manufacturing. Sometimes, when the terminal is being connected to a long wire, it is laid on the floor and stepped on by a worker. It would be advantageous that terminals subjected to such crushing forces provide a good connection. These are some of the problems this invention overcomes.

SUMMARY OF THE INVENTION

A contact blade coupling means for contacting an electric connector having a generally blade-like or planar configuration includes a first and a second pair of side members. The first pair of generally planar, elongated side members includes a first inside member and a first outside member and are joined to one another at least along a portion of a first common edge and have first spacing means to limit bending about the first common edge toward one another so that the side members of the first pair are substantially parallel to each other.

Similarly, a second pair of generally planar, elongated side members includes a second inside member and a second outside member. The inside member and outside member are joined to one another at least along a portion of a second common edge. Also, the second inside and outside members have second spacing means to limit bending toward one another so that the second pair of side members are substantially parallel to each other.

The first and second pairs of elongated side members are also parallel to one another. The first inside and second inside members are spring contacts and are positioned in prestressed contact against one another along the length of a contact line and are movable about parallel axes so that there is an increased contact force for holding an intermediate electrical blade connector.

DETAILED DESCRIPTION OF THE INVENTION

Figure 1:
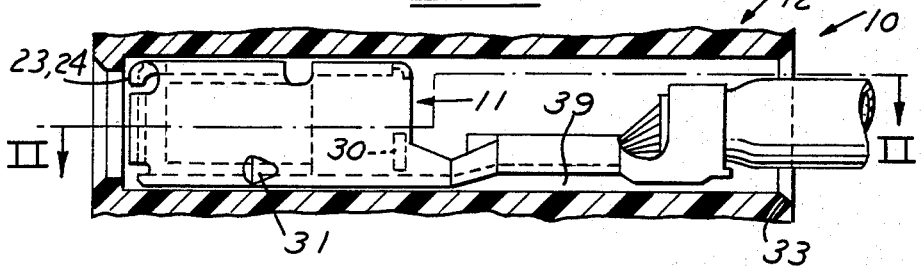
FIG. 1 is a cross section view of a connector with a terminal positioned therein.
Figure 2:
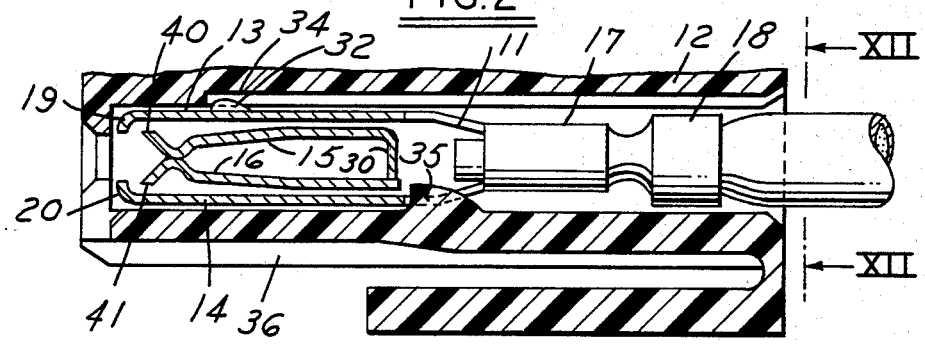
FIG. 2 is a section view along line II—II of FIG. 1.

Referring to FIG. 1, a coupling means 10 includes a terminal 11 and a connector 12. Referring to FIG. 2, terminal 11 has a pair of elongated side members 13 and 14 and a pair of opposing spring contacts 15 and 16. Terminal 11 includes a pair of wire crimp tabs 17 for electrically connecting a wire to terminal 11 and a pair of insulation crimp tabs 18 for attaching terminal 11 to the insulation of a conducting wire.

Figure 8:
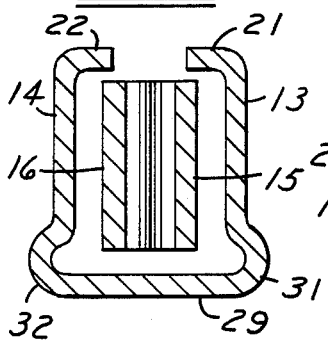
FIG. 8 is a section view along line VIII—VIII of FIG. 6 without the blade connector.

To facilitate insertion of terminal 11 through a circular opening in a rubber seal (not shown) so as to prevent moisture from entering connector 12, terminal 11 has various streamlined features to prevent tearing of the rubber seal as terminal 11 is inserted. Side members 13 and 14 include forward prows 19 and 20 bent so as to present a curved surface. Side members 13 and 14 also include side shields 21 and 22 (FIG. 8), respectively, for covering the area between side members 13 and 14 and spring contacts 15 and 16. Side shields 21 and 22 have lances 23 and 24 (see FIG. 1), respectively, extending forward and bent toward forward prows 19 and 20 so as to form a rounded corner for terminal 11.

Figure 3:
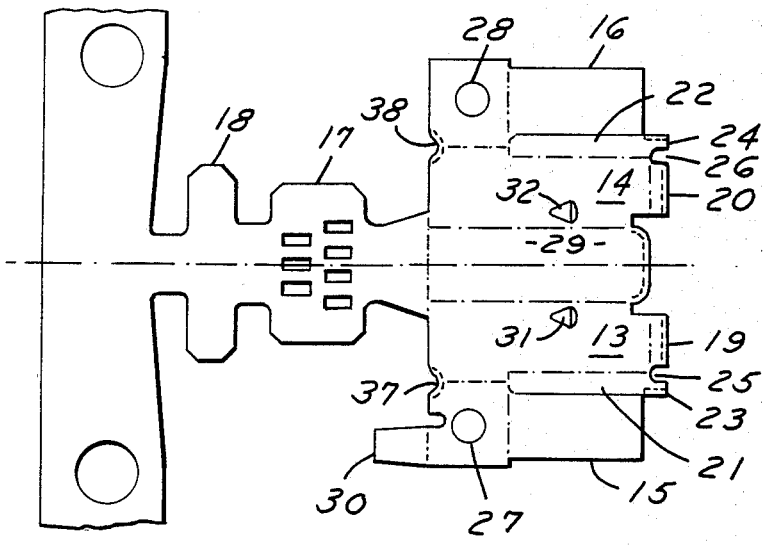
FIG. 3 is a plan view of a blank for forming a terminal in accordance with an embodiment of this invention.
Figure 9:
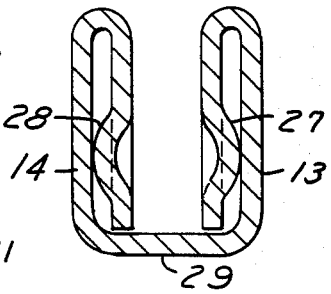
FIG. 9 is a section view along line IX—IX of a FIG. 6 without the blade connector.

Referring to FIG. 3, to form forward prows 19 and 20 and lances 23 and 24, cutouts 25 and 26 are formed in the blank for terminal 11. Cutout 25 is between lance 23 and forward prow 19, and cutout 26 is between forward prow 20 and lance 24. A stop button 27 is formed in spring contact 15 and a stop button 28 is formed in spring contact 16 by a deformable drawing process (see FIG. 9). As spring contact 15 is folded over toward side member 13, stop button 27 engages side member 13 so as to align spring contact in a parallel relationship to side member 13. Similarly, when spring contact 16 is folded toward side member 14 stop button 28 engages side member 14 to assure parallel alignment of spring contact 16 with side member 14. A base 29 connects side members 13 and 14 to each other so that when side members 14 and 13 are bent upwardly they can achieve a parallel relationship to each other.

Figure 4:
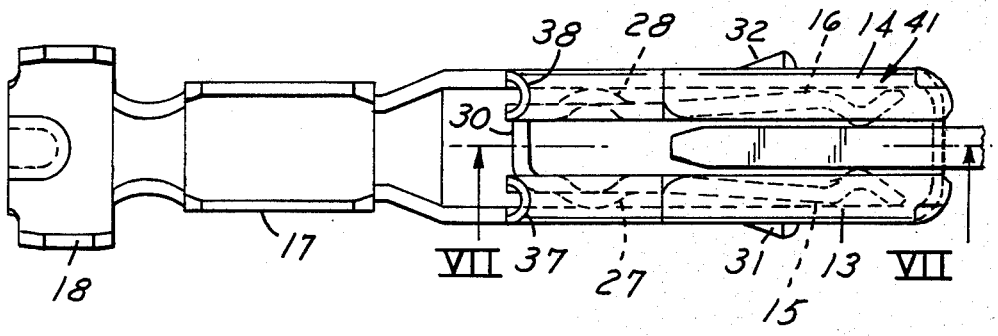
FIG. 4 is a top view of a terminal in accordance with an embodiment of this invention coupled to a blade connector.
Figure 6:
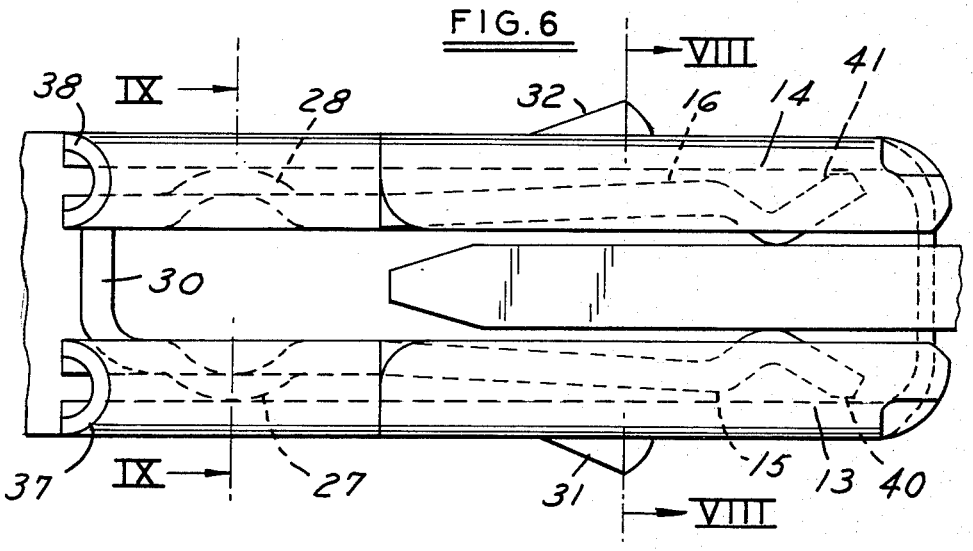
FIG. 6 is an enlarged view of the forward portion of the terminal and blade connector shown in FIG. 4.
Figure 7:
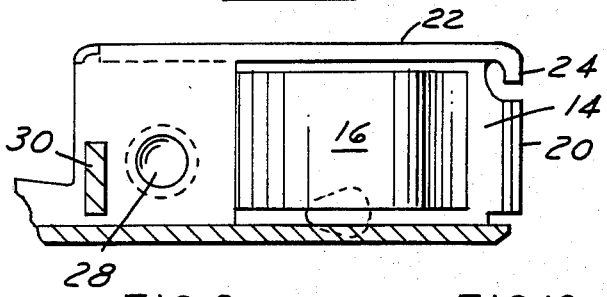
FIG. 7 is a section view taken substantially along line VII—VII of FIG. 4 without the blade connector.

Because of stop buttons 27 and 28, when side members 13 and 14 are parallel to each other then spring contacts 15 and 16 are also parallel to each other and provide a full line of contact between them to receive therebetween a blade connector. Advantageously, spring contacts 15 and 16 are in a stressed position when in the final configuration so as to improve the applied force to a blade connector placed between spring contacts 15 and 16. A spacer 30 extends rearward from spring contact 15 and is bent toward spring contact 16 thereby resisting undesirable crushing of terminal 11 (FIGS. 4 and 6). Terminal insertion guides 31 and 32 are formed in side members 13 and 14, respectively, and act as a stop when inserting terminal 11 into connector 12 and as polarizing means so that terminal 11 can be inserted in only one orientation into connector 12 (FIGS. 1 and 2).

Connector 12 includes an entrance bevel 33 (see FIG. 1) for guiding the forward portion of the terminal 11 into the opening of connector 12. Connector 12 also includes a slot 34 (see FIG. 2) for receiving terminal insertion guide 32. A locking ramp 35 extends into the opening of connector 12 to engage the rearward portion of side member 14. Locking ramp 35 is positioned on locking finger 36 which is movable so as to release terminal 11 from connector 12.

Figure 5:
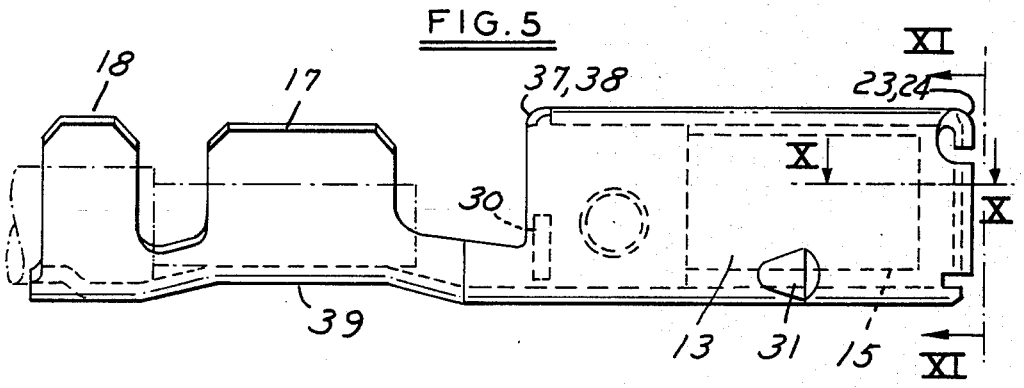
FIG. 5 is a side view of a terminal in accordance with an embodiment of this invention.

Referring to FIG. 5, a rear profile indentation 37 and 38 at the joining area of spring contact 15 to side member 13 and spring contact 16 to side member 14 facilitates removal of terminal 11 without tearing of a sealing grommet gland.

Terminal 11 also includes an offset 39 adjacent wire crimp tabs 17 so that in the terminal conductor grip area there is provided a straight wire assembly (FIG. 5). This is advantageous so that the insulator and conductor wire can remain coaxial when being attached to terminal 11, without a need to drop the base of insulation crimp tabs 18 to below the base of terminal 11.

As best shown in FIG. 6, the forward portion of spring contacts 15 and 16 have sidewardly extending wings 40 and 41, respectively, which engage sidewalls 13 and 14 to prevent overstress. That is, the sidewalls of the box formed by terminal 11 restrict spring contacts 15 and 16 from overstress, permanent set and loss of contact pressure.

Figure 10:
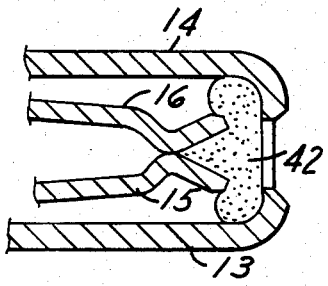
FIG. 10 is a section view along line X—X of FIG. 5.
Figure 11:
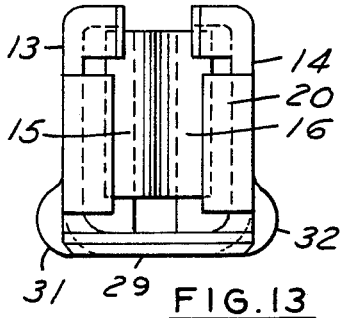
FIG. 11 is an end view of the terminal along line XI—XI of FIG. 5.

Referring to FIG. 10, grease 42 is inserted into the tip of terminal 11 after fabrication so as to prevent oxidation of the surfaces of terminal 11 and reduce the resistance which is particularly advantageous for low current applications.

Figure 13:
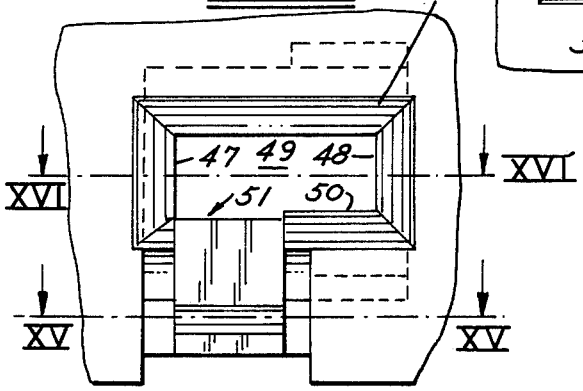
FIG. 13 is an end view of the connector, opposite from the end of FIG. 12.
Figure 14:
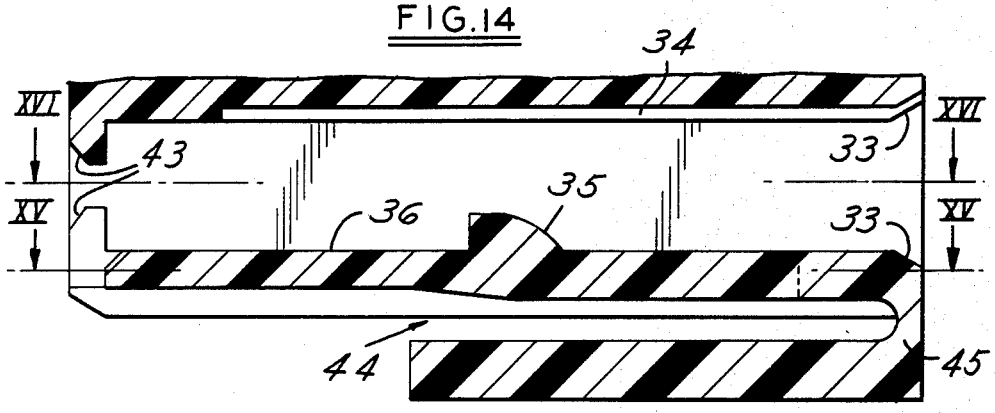
FIG. 14 is an enlarged section view of the connector of FIG. 2.
Figure 15:
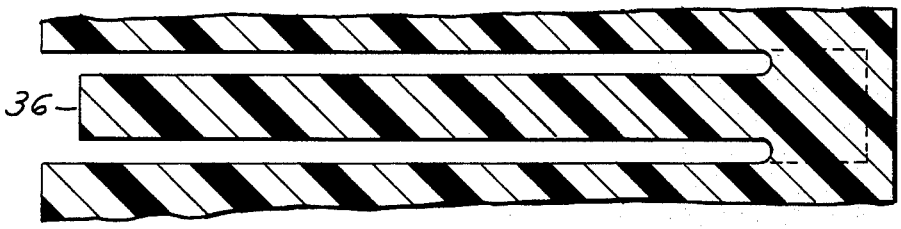
FIG. 15 is a section view taken along line XV—XV of FIGS. 13 and 14.
Figure 16:
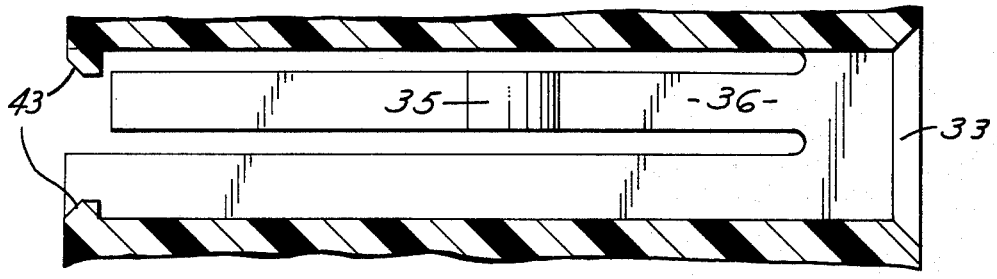
FIG. 16 is a section view taken along line XVI—XVI of FIGS. 13 and 14.

Referring to FIG. 13, a bevel 43 acts to guide the blade connector into connector 12 for insertion into terminal 11. Referring to FIG. 14, a minimum gap 44 has a dimension to facilitate terminal removal and yet provide overstress protection for locking finger 36 during terminal removal. A wall 45 between locking finger 36 and the remainder of connector 12 has a thickness sufficiently thin so that cooling of connector 12, after molding of a plastic material, does not result in warpage of locking finger 36.

Figure 12:
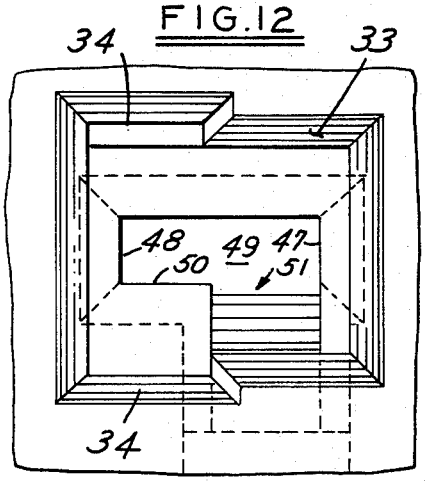
FIG. 12 is an end view of the entrance of the connector along line XII—XII of FIG. 2.

Referring to FIGS. 12 and 13, connector 12 has side walls 47 and 48 bounding a central opening 49. A floor 50 bounds the base of opening 49. An opening 51 is adjacent side wall 47 so that floor 50 extends from side wall 48 to opening 51. By placing opening 51 directly adjacent one side wall, the continuous extent of floor 50 is maximized. Such an increased extent of the floor improves support for terminal 11 and reduces the criticality of the exact width of the floor. If the opening were in the middle of the floor, so that the floor extended from each side wall, a variation in floor width could cause loss of support for the terminal on one side.

Various modifications and variations will no doubt occur to those skilled in the various arts to which this invention pertains. For example, the particular relative sizes of the features of the terminals and connectors may vary from that described herein. These and all other variations which basically rely on the teachings through which this disclosure has advanced the art are properly considered within the scope of this invention.

We claim:

1. A contact blade coupling means for contacting an electrical connector having a generally planar configuration, said coupling means including a terminal comprising:

a first pair of generally planar, elongated side members including a first inside member and a first outside member and joined to one another at least along a portion of a first common edge and having first spacing means to limit bending about said first common edge toward one another so that said first pair of side members are substantially parallel to each other;

a second pair of generally planar elongated side members including a second inside member and a second outside member joined to one another at least along a portion of a second common edge and having second spacing means to limit bending toward one another so that said second pair of side members are substantially parallel to each other, and so that said first and second pairs of elongated side members are parallel to each other;

said first inside and second inside members being spring contacts and positioned in prestressed contact against one another and movable about parallel axes so that there is an increased contact force for holding an intermediate electrical blade connector;

a bracer means extending between said first and second inside members, and connected integrally to one of said first and second inside members, so as to provide a barrier to maintain the spacing between said first and second inside members even in the presence of a compressing force; and said bracer means being a tab extending generally perpendicular out from one end of said first inside member, said tab being on one side of said spacing means and said coupling means further comprising a first contact spring surface on the other side of said spacing means on said first inside member.

* * * * *